US005292019A

United States Patent [19]

Patterson

[11] Patent Number: 5,292,019

[45] Date of Patent: Mar. 8, 1994

[54] TAMPER EVIDENT CAP AND CONTAINER

[75] Inventor: Michael C. Patterson, Longview, Wash.

[73] Assignees: L. Ring; R. Ring; Closure Technologies, Inc.; M. Patterson, ; a part interest

[21] Appl. No.: 867,143

[22] Filed: Apr. 10, 1992

Related U.S. Application Data

[63] Continuation-in-part of Ser. No. 621,765, Dec. 4, 1990, Pat. No. 5,111,947.

[51] Int. Cl.[5] ..... B65D 41/32

[52] U.S. Cl. ..... 215/256; 215/254; 215/258

[58] Field of Search ..... 215/256, 254, 253, 252, 215/258, 305

[56] References Cited

U.S. PATENT DOCUMENTS

| | | | |
|---|---|---|---|
| 831,271 | 9/1906 | Fenn | 215/256 |
| 2,104,236 | 1/1938 | Mermer | 215/252 |
| 2,134,178 | 10/1938 | Esposito . | |
| 2,423,582 | 7/1947 | Coleman | 215/252 |
| 3,310,191 | 3/1967 | Kern et al. . | |
| 3,415,403 | 12/1968 | Sardell . | |
| 3,812,994 | 5/1974 | Feldman . | |
| 3,850,329 | 11/1974 | Robinson . | |
| 3,893,583 | 7/1975 | McLaren | 215/256 |
| 3,901,404 | 8/1975 | Feldman . | |
| 3,902,621 | 9/1975 | Hidding . | |
| 3,955,696 | 5/1976 | Finke . | |
| 3,980,195 | 9/1976 | Fillmore . | |
| 4,062,466 | 12/1977 | Conti . | |
| 4,076,140 | 2/1978 | Perne . | |
| 4,131,212 | 12/1978 | Rumball . | |
| 4,337,870 | 7/1983 | Keeler . | |
| 4,402,415 | 9/1983 | Hopley | 215/256 |
| 4,418,828 | 12/1983 | Wilde et al. . | |
| 4,480,761 | 11/1984 | Aichinger . | |
| 4,530,438 | 7/1985 | McDevitt . | |
| 4,534,480 | 8/1985 | Santostasi et al. . | |
| 4,540,101 | 9/1985 | Kutcher | 215/252 |
| 4,550,845 | 11/1985 | Guala . | |
| 4,567,991 | 2/1986 | Anderson . | |
| 4,573,598 | 3/1986 | Perry . | |
| 4,575,388 | 2/1986 | Luker et al. . | |
| 4,597,500 | 7/1986 | Stubbs . | |
| 4,646,926 | 3/1987 | Agbay et al. . | |
| 4,771,904 | 9/1988 | Perne et al. . | |
| 4,813,561 | 3/1989 | Ochs . | |
| 4,828,127 | 5/1989 | Young et al. | 215/252 |
| 4,848,613 | 7/1989 | Nofer . | |
| 4,984,701 | 1/1991 | Margaria . | |
| 5,115,932 | 5/1992 | Schneider | 215/258 X |

FOREIGN PATENT DOCUMENTS

| | | | |
|---|---|---|---|
| 2442341 | 9/1974 | Fed. Rep. of Germany | 215/256 |
| 1-85250 | 6/1989 | Japan . | |
| 108041 | 2/1989 | Taiwan . | |
| 977312 | 12/1964 | United Kingdom . | |
| 2031856 | 4/1980 | United Kingdom | 215/256 |

*Primary Examiner*—Allan N. Shoap
*Assistant Examiner*—Paul A. Schwarz
*Attorney, Agent, or Firm*—Klarquist Sparkman Campbell Leigh & Whinston

[57] ABSTRACT

A tamper evident cap designed for threading onto a container by conventional bottle capping machinery. The cap includes a first set of spaced-apart lugs for engaging a second set of spaced-apart lugs of a container. The lugs of the cap and the lugs of the container neck are constructed to slide relative to each other upon threading of the cap onto the container while engaging each other to prevent unthreading of the cap from the container. The container neck is especially suited for glass bottles which must be blow molded. The cap includes a first skirt portion and a separable strip, and may include a second skirt portion that remains on the container neck after the separable strip has been removed. The gap between the skirt portions left by removing the separable strip indicates that the cap has been tampered with.

7 Claims, 5 Drawing Sheets

TAMPER EVIDENT CAP AND CONTAINER

RELATED APPLICATION DATA

This application is a continuation-in-part of U.S. patent application Ser. No. 07/621,765, filed Dec. 4, 1990, now U.S. Pat. No. 5, 111,947.

BACKGROUND OF THE INVENTION

This invention relates generally to threaded caps and containers. More particularly, the invention relates to caps and containers that are tamper evident in the sense that any tampering with the cap when sealed to the container is clearly visible.

Tamper-evident caps ("closures") and related containers are used to indicate to a prospective purchaser whether the container has been tampered with. Several approaches are in use, ranging from tear bands whose removal indicates a cap has been unthreaded to plastic shrink bands that must first be torn off to unscrew the cap.

One drawback of many of these prior approaches is the need for special capping machinery in order to mount the tamper-evident cap to the container. Conventional capping machinery, especially where the containers are glass, simply threads the cap onto the container. For example, caps that use a snap ring below the threads, such as the tamper-evident cap shown and described in U.S. Pat. No. 4,984,701, cannot be used by industry-standard bottle capping machinery that is designed for mounting conventional caps, lids, etc. The cap therein must be heated for expansion before applying it to the container, and the cap must be initially pressed onto the container before it can be threaded. Conventional capping machinery lacks means for heating or pressing a cap onto a container. Rather, special capping machinery of a significant cost is required to mount such caps to containers.

Another drawback of prior tamper-evident caps is that many require a container neck that cannot be easily blow molded, a common method of molding glass containers. Plastic containers such as milk jugs may be blow molded with less heat and pressure, allowing many diverse and multiple angles. But glass containers, which are preferable for storing many types of food products, generally cannot be molded in a way that allows many diverse and multiple angles due to the propensity of glass to break rather than bend. For example, U.S. Pat. No. 4,131,212 shows and describes a container and closure that uses complementary rachet teeth to lock the closure to the container. But the shape number and arrangement of the teeth requires that the container be made by injection molding onto a blank of flexible sheet material. Glass containers cannot readily be made in this manner.

Another drawback of most tamper evident closures is the ease with which a tamperer can reclose a container and mask the tampering, because the container still holds the separated portions in their approximately untampered relationships.

The tamper-evident cap that is the subject of the present invention suffers from none of these drawbacks. It can be mounted with conventional capping machinery onto a complementary container. And the container may be readily blow molded made from glass as well as made from other materials.

SUMMARY OF THE INVENTION

An object of the invention, therefore, is to provide an improved tamper evident cap and container.

Another object of the inventions is to provide a tamper evident cap that can be mounted to a container with conventional capping machinery.

Yet another object of the invention is to provide a container, complementary to the tamper evident cap, that can be made from glass as well as other materials.

Yet another object of the invention makes it difficult or impossible to reposition the tampered-with components to mask the tampering.

In accordance with the invention, a tamper-evident cap for use on a threaded container neck is disclosed. The cap comprises a top portion from which a skirt portion depends. The skirt portion has internal threads complementary to threads on a container with which the cap is used. Depending from the skirt portion is a separable strip having a first set of lugs. The lugs of the separable strip are constructed to slide along a smooth surface of the container neck and over a second set of lugs extending outward from the neck's smooth surface upon rotation of the cap in a threading direction. However, the lugs of the separable strip engage the second set of lugs to prevent relative rotation in an unthreading direction.

In accordance with the invention, also disclosed is a container neck for use with a tamper-evident cap having a first set of spaced-apart lugs. The container neck comprises a first annular portion threaded for engaging the threads of the cap. A second annular portion below the first has a smooth surface and a second set of lugs. The second set of lugs is constructed to slide under the first set of lugs upon rotation of the cap in a threading direction. The second set of lugs engages the first set of lugs to prevent rotation in an unthreading direction.

In another embodiment of the invention, the tamper evident cap includes a second skirt portion depending from the separable strip. The first set of spaced-apart lugs extends inward from the separable strip or the second skirt portion. Upon removal of the separable strip, the gap between the second skirt portion and first skirt portion indicates that the cap and container have been tampered with.

The first set of lugs may extend inward from both the separable strip and second skirt portion to provide additional resistance against unthreading. The second set of lugs on the container neck may include sufficient lugs for engaging additional lugs on both the separable strip and second skirt portion. The second set of lugs may be attached in more than one plane through the container neck.

There could be one or more sets of lugs used, depending on the diameter of the cap and container.

The foregoing and other objects, features, and advantages of the invention will become more apparent from the following detailed description of several preferred embodiments which proceeds with reference to the accompanying drawings.

DESCRIPTION OF PREFERRED EMBODIMENTS

First Embodiment

Figure 1:
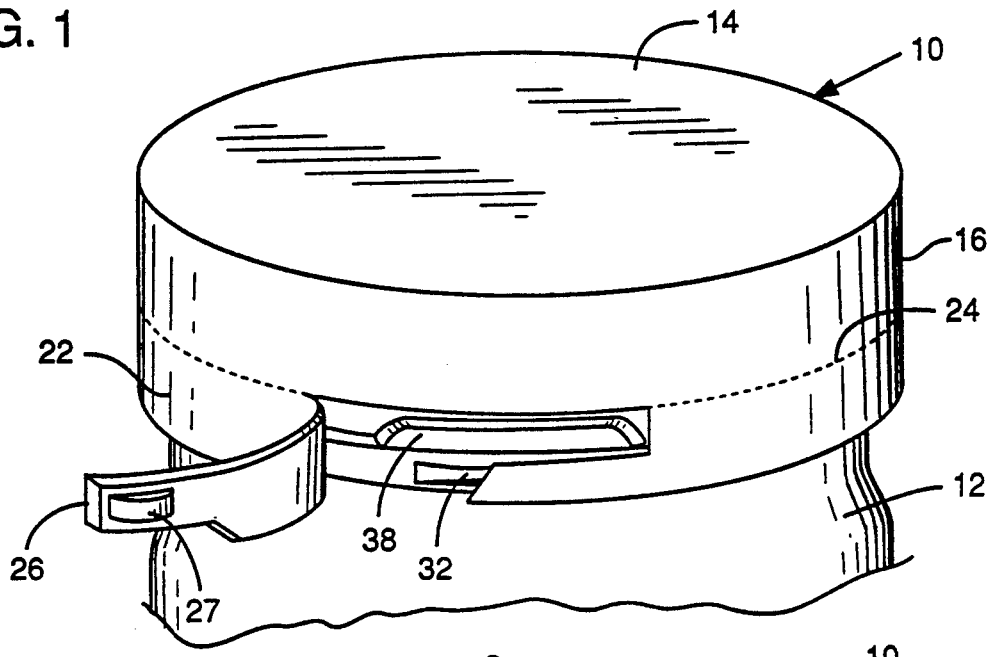
FIG. 1 is a perspective view of a tamper evident cap according to the invention, with a tab on the separable strip pulled back.
Figure 2:
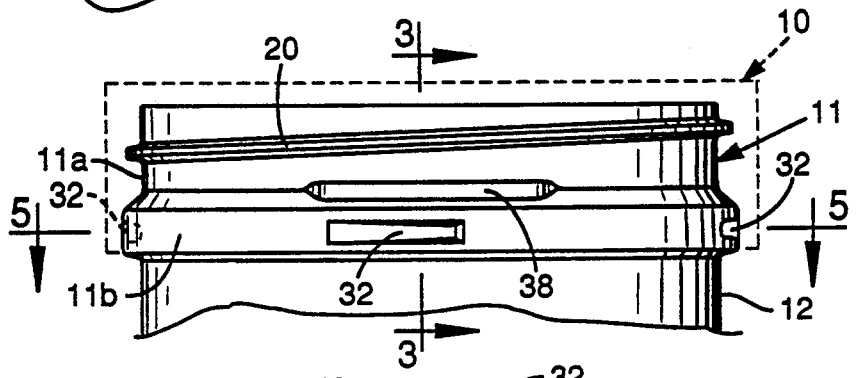
FIG. 2 is a side view of a container neck or "finish" according to the invention.
Figure 3:
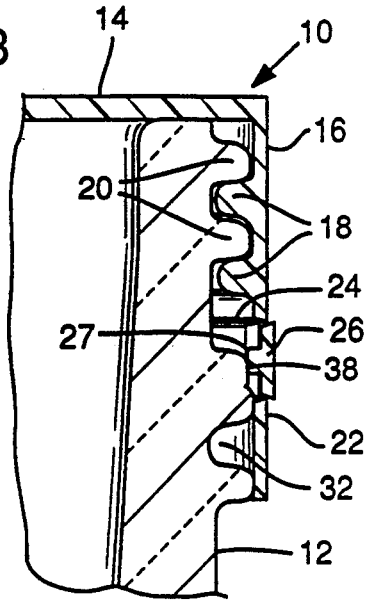
FIG. 3 is a cross sectional view of the engaged container neck and cap taken along line 3—3 of FIG. 2.

Referring now to FIGS. 1-3, there is shown a first embodiment of a tamper evident closure or cap 10 threadably mounted to a neck 11 of a container 12. Container 12 may be made of plastic, glass or other suitable material. The container neck 11 is also commonly known as a container finish and the terms are equivalent herein. The cap 10 is made of a pliable material such as plastic. The cap 10 comprises a circular top portion 14 from which depends an annular skirt portion 16. The skirt portion 16 has internal threads 18 that complement container threads 20 for screwing the cap 10 onto the container 12.

Figure 4:
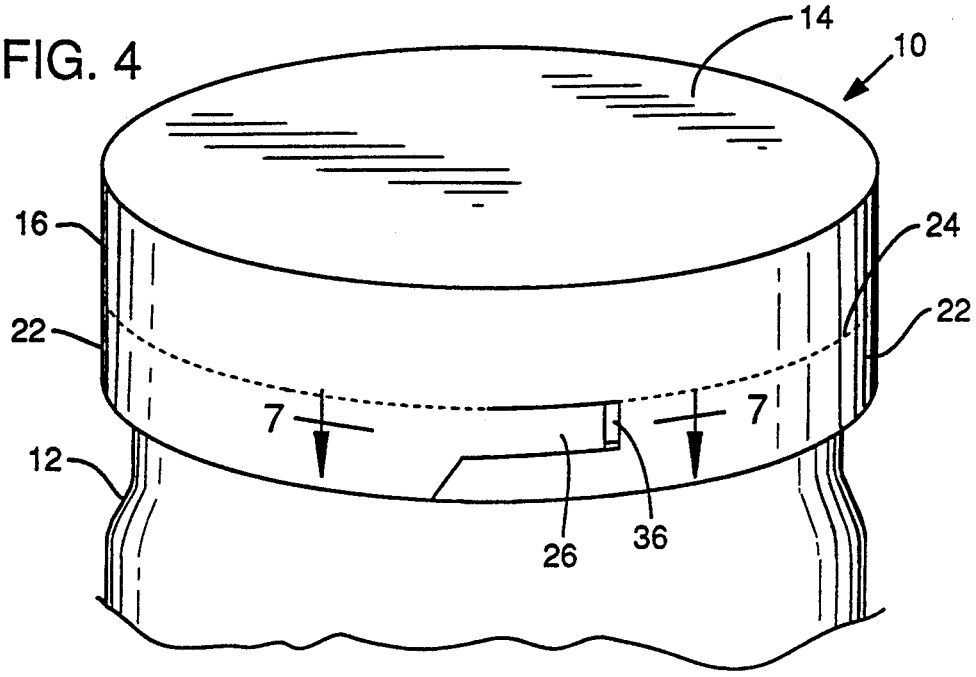
FIG. 4 is another perspective view of the cap, with the separating tab as it rests circularly aligned with the rest of the cap.

Depending from the bottom of the skirt portion 16 is a tear band or separable strip 22. In this embodiment, the separable strip is constructed to be entirely removed from the neck 11 upon severing the strip from skirt portion 16. The boundary between skirt portion 16 and the strip 22 is defined by a line of weakness 24 in the cap material. To sever and thus separate the separable strip 22 from skirt portion 16, a handle such as a tab 26 is formed on a free end of the strip. On the inside of tub 26 is a protrusion 27 for pressing the tab 26 outward of the cap 10. FIG. 4 illustrates how the tab 26 is substantially circularly aligned with the strip 22 when not being grasped.

Figure 5:
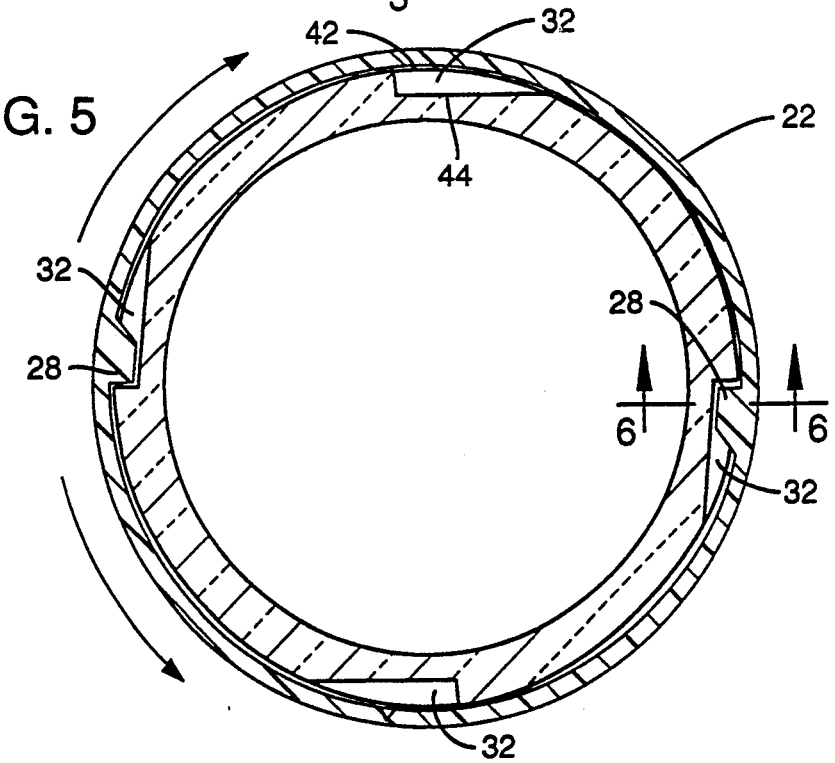
FIG. 5 is a cross sectional view of the bottle neck taken along line 5—5 of FIG. 2.
Figure 6:
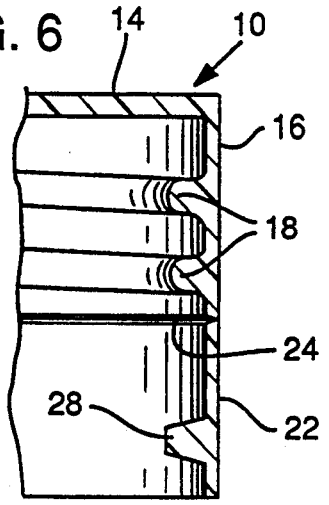
FIG. 6 is a cross sectional view of the cap taken along line 6—6 of FIG. 5 with the bottle removed.

Means are provided for interlocking the cap 10 to the container neck 11 to prevent leakage of the container's contents. This is best seen in FIGS. 3, 5 and 6. FIG. 6 is a cross sectional view of the cap 10 alone, while FIG. 3 is a cross sectional view of the cap threaded to container neck 11. The separable strip 22 includes on its lower portion a pair of opposing internal lugs or teeth 28 designed to interlock with lugs or notches 32 defined within the neck 11 of container 12. The teeth 28 and notches 32 form two portions of an interlocking tooth and notch arrangement below the container threads 20 on the neck 11. As evident from FIG. 5, the teeth 28 and notches 32 are constructed in pawl-like fashion. This allows the teeth to slide past the notches upon rotation of the cap relative to the neck 11 in a threading direction, while causing the teeth to engage the notches to prevent rotation of the cap in an unthreading direction. In the present embodiment the notches 32 are defined within the container neck 11 and the teeth 28 are formed internally on the separable strip 22. However, this may be reversed, with the teeth defined within the container neck 11 and the notches or lugs defined on the strip 22 if desired.

Figure 7:
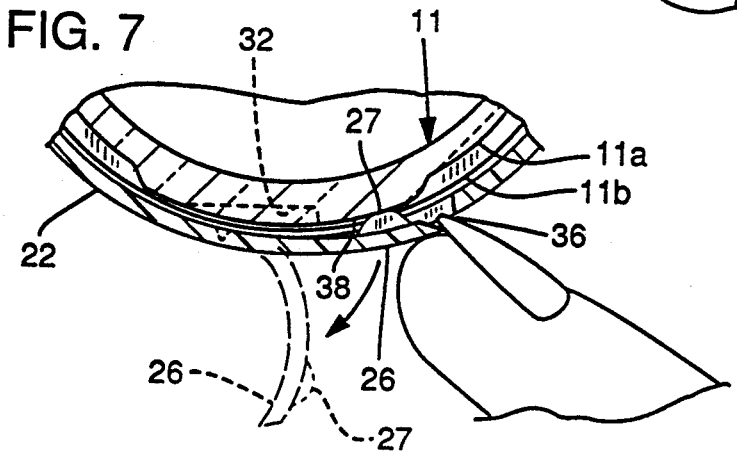
FIG. 7 is a cross sectional view of the cap taken along line 7—7 of FIG. 4.

As shown in FIG. 4, the tab 26 is substantially circularly aligned with the rest of strip 22 when the cap 10 is threaded onto the neck 11. To permit grasping of tab 26, the strip 22 defines a small gap 36 between the end of the tab 26 and the adjacent portion of the separable strip. This permits a person to grasp the tab 26 as shown in FIG. 7. The container 12 may also include a protrusion 38, (FIGS. 1 and 2) positioned on the neck 11 below the threads 20. The protrusion 38 engages protrusion 27 when the cap 10 is threaded completely onto neck 11 and the teeth 28 are engaged with container notches 32, forcing the tab 26 slightly outward from the strip 22. To remove the cap 10, one grasps the tab 26 as shown in FIG. 7 and pulls it around the neck 11, as shown in FIG. 1. This action severs the strip 22 from the skirt portion 16 along the line of weakness 24, thereby allowing the skirt portion to be unthreaded from the container neck 11.

FIGS. 2 and 5 show the container neck 11 in greater detail. The neck 11 includes an upper annular portion 11*a* that contains the threads 20 that complement the threads 18 of the cap 10. Below the threads 20 is a lower annular portion 11*b* (of slightly greater diameter then the upper portion 11*a*) in which the notches 32 are defined. Each notch 32 has a first substantially radially extending surface 42 and a second surface 44 extending from the circumference of the second portion to intersect the surface 42 at substantially a right angle. The notches 32 are all situated in a single plane through the container 12 perpendicular to container's longitudinal axis.

An advantage of a tamper evident cap constructed according to the invention is the ease of mounting it on a container. Unlike prior caps that include sealing rings which require special mounting equipment, the cap 10 can be mounted by threading it on to the container 12 with conventional capping machinery. With reference to FIG. 5, as the cap 10 is threaded clockwise, the internal teeth 28 slide along the annular neck portion 11*b* and over the notches 32. The four notches 32 are spaced about 90° apart on container to each engage a tooth 28. This spacing allows a cap to be tightened sufficiently to prevent leakage without being overtightened to the point of damaging the cap's structure.

A second advantage of the cap 10 is the need to remove the strip 22 in order to unthread the cap from the container neck 11. The line of weakness 24 is of sufficient strength to prevent the mere twisting of the cap off the container with the strip 22 still in place. A force of magnitude sufficient to otherwise remove the cap with the strip in place would permanently deform the cap to a point that such tampering would be clearly evident. Many tamper evident caps of prior design rely on the user twisting the cap with sufficient force to break bridge structure between the cap and the sealing ring. However, such caps can be replaced on the container neck and realigned with the sealing such that the cap's removal is not easily detected. In contrast, any tampering with cap 10 is readily evident by lack of the strip 22.

Second Embodiment

Figure 8:
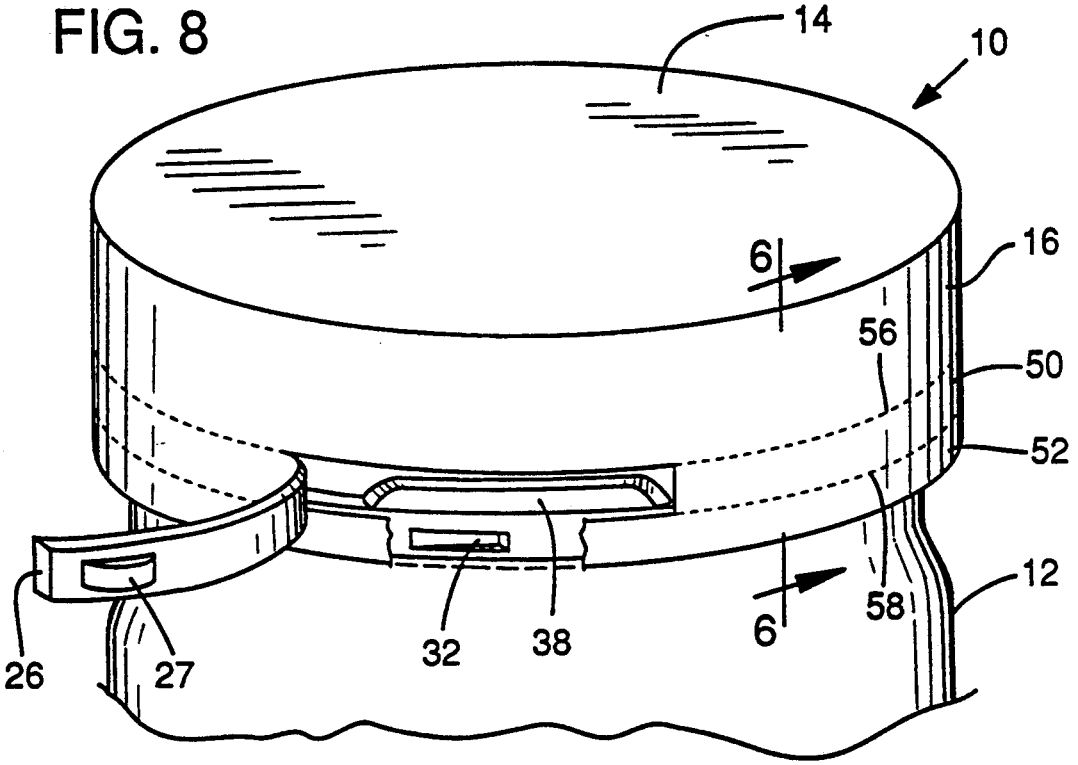
FIG. 8 is a perspective view of a second embodiment of a tamper evident cap according to the invention.
Figure 9:
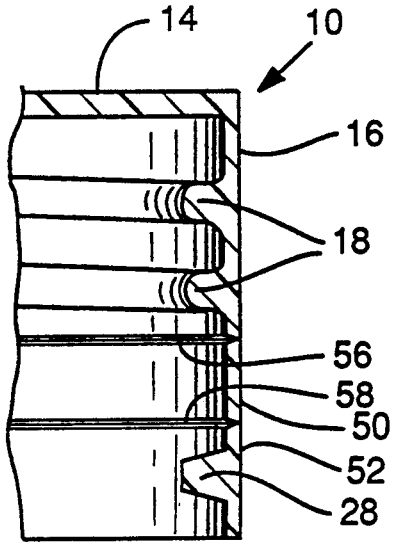
FIG. 9 is a cross sectional view of the cap of FIG. 8.

A second embodiment of a cap according to the invention is shown in FIGS. 8 and 9, where the same reference numerals are used for elements present in common with the first embodiment. In this embodiment a portion of the separable strip 22 remains on the container neck as a second skirt portion upon severing the strip from the skirt portion 16. Appearing in place of the separable strip 22 are an intermediate separable strip 50 and a second annular skirt portion 52. The strip 50 depends from the bottom of the first skirt portion 16, the boundary between the first skirt portion 16 and the strip being defined by a first line of weakness 56. The annular skirt portion 52 depends from the bottom of the strip 50, the boundary between the two being defined by a second line of weakness 58. The skirt portion 52 has internally one portion of the tooth and notch arrangement to engage the other portion defined on the annular portion 11*b* of the container neck. As shown in FIGS. 8 and 9, in this embodiment the second skirt portion 52 includes internally the teeth 28 and the container neck 11 defines the notches 32. As in the first embodiment, strip 50 includes an internal protrusion 27 that engages the protrusion 38 of the container neck 11 when the cap is threaded completely onto the neck.

This second embodiment has the advantages of the first embodiment, plus the fact that tampering with the cap 10 is even more evident. If the strip 50 is removed, the resultant gap between the first skirt portion 16 and the second skirt portion 50 clearly indicates tampering.

Third Embodiment

Figure 10:
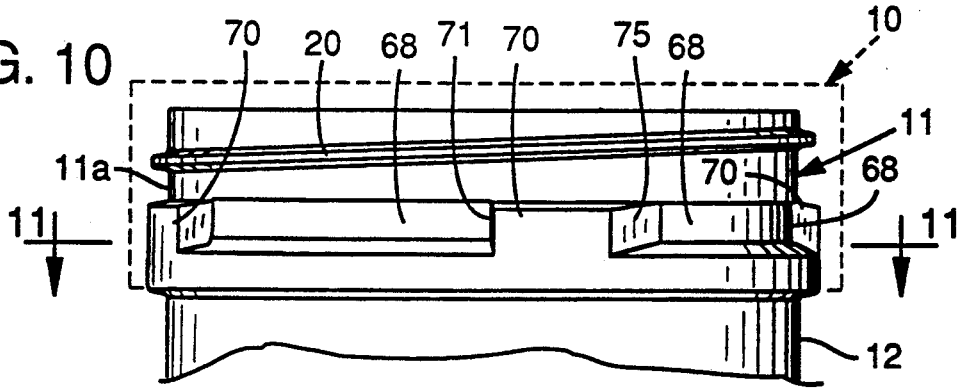
FIG. 10 is a side view of another container neck according to the invention.
Figure 11:
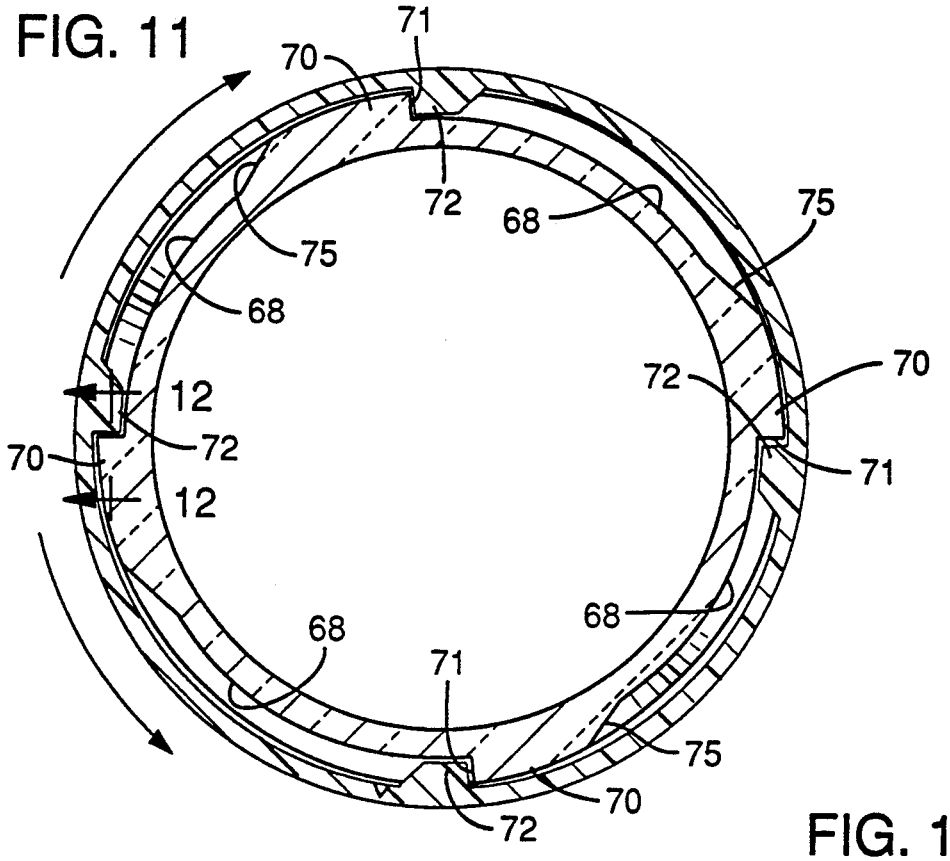
FIG. 11 is a cross sectional view of an engaged container neck and cap taken along line 11—11 of FIG. 10.

FIG. 10 is a side view of another container neck 11 according to the invention. The second annular portion in this embodiment is a smooth surface 68 from which a set of spaced-apart lugs 70 extend outward. Alternatively, the lugs 70 may comprise notches within the container neck 11. The smooth surface 68, which is slightly recessed to a uniform depth in the neck 11, and second set of lugs 70 are constructed to allow the lugs 70 to slide relative to a first set of spaced-apart internal lugs 72 on the cap 10 (FIGS. 11, 12) upon rotation of the cap 10 in a threading direction. When an attempt is made to rotate the cap 10 in an unthreading direction, the lugs 70 engage the lugs 72 to prevent such rotation and unthreading. FIG. 11 illustrates best this co-action. The lugs 70 have an engaging surface 71 that extends substantially radially (i.e., perpendicular to the smooth surface 68) for engaging a lug 72 when the cap 10 is rotated in an unthreading direction. The lugs 70 also have a sloped rear surface 75 for allowing a lug 72 to slide over the lug 70 when the cap is rotated in a threading direction.

Figure 12:
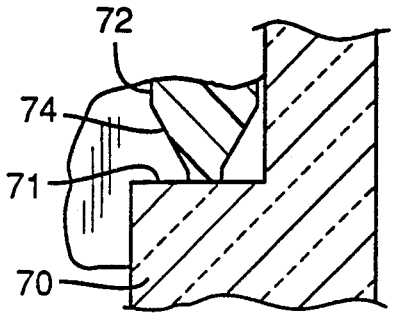
FIG. 12 is a magnified cross sectional view of a tapered lug of a cap engaging a lug of a container neck taken along line 12—12 of FIG. 11.

Either embodiment of the cap 10 described above may be used on this embodiment of the container neck 11. To improve the engagement of lugs 70 and 72, lugs 72 may be tapered to allow for compression upon engaging lugs 70, as shown in FIG. 12. The compressibility of the tapered portion 74 allows a margin of error in alignment of the lugs 72 relative to the lugs 70. That is, the lugs 72 and lugs 70 need not be exactly the same degrees apart on the container neck 11 and cap 10, respectively, because the tapered lug 72 will compress to accommodate an error.

Figure 13:
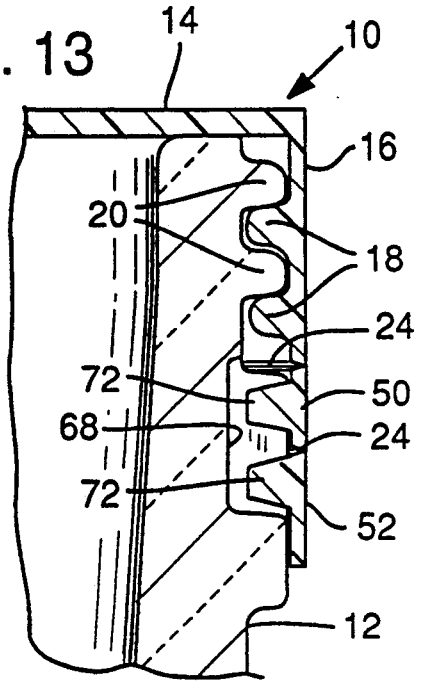
FIG. 13 is a cross sectional view of a cap and container neck taken along line 13—13 of FIG. 11.
Figure 14:
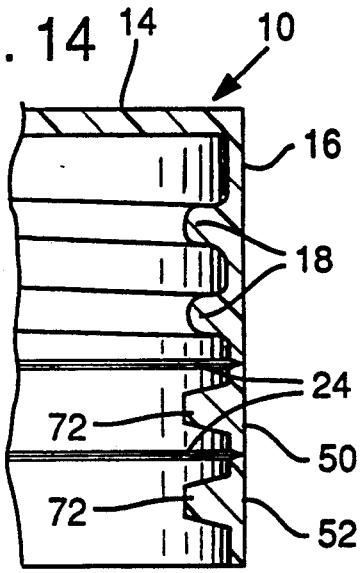
FIG. 14 is a cross sectional view of the cap taken along line 13—13 with the container removed.
Figure 15:
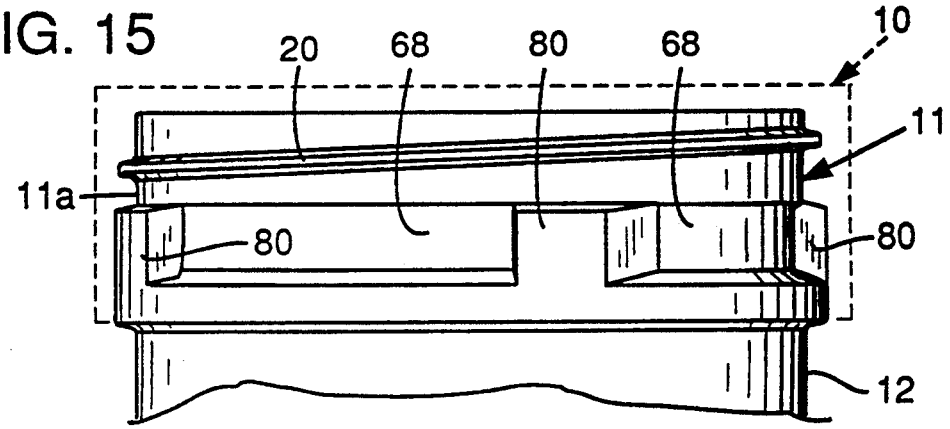
FIG. 15 is a side view of another container neck according to the invention with lugs of increased width.
Figure 16:
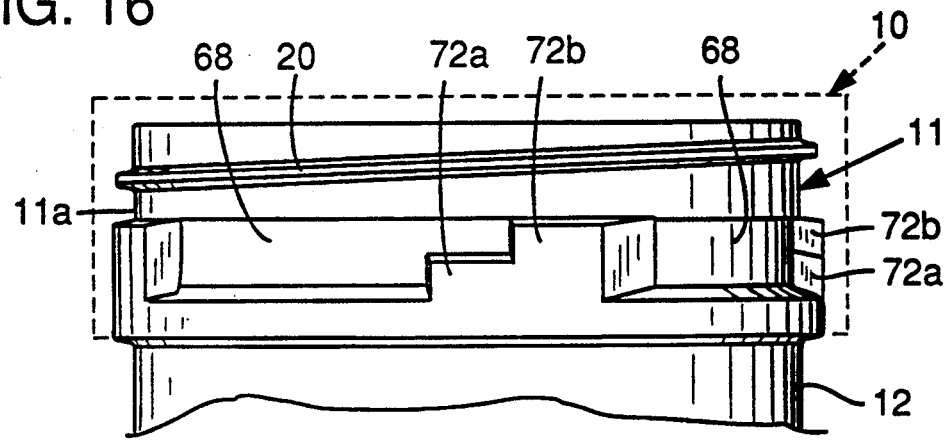
FIG. 16 is a side view of another container neck according to the invention with lugs in more than one plane through the container neck.

FIGS. 15 and 16 show variations on the size and placement of the lugs 70 extending outward from the smooth surface 68 of the container neck 11. Alternatively, the lugs 80 may comprise notches within the container neck 11. Lugs 80 in FIG. 15 are wide enough to engage lugs 72 extending inward on either or both of the separable strip 50 and second skirt portion 52 for added resistance to unthreading as shown in FIGS. 13 and 14. In FIG. 16, the lugs 72 are staggered as lugs 72*a* and 72*b*.

Having illustrated and described the principles of the invention in a preferred embodiment, it should be apparent to those skilled in the art that the invention can be modified in arrangement and detail without departing from such principles.

I claim:

1. A tamper-evident system comprising:

(a) a container having a neck including:

a threaded annular portion;

a set of lugs constructed on the container neck below the threaded annular portion; and (b) a cap including:

a top portion;

a first skirt portion depending from the top portion and having internal threads complementary to the container threads;

an intermediate separable strip depending from the first skirt portion, a boundary between the first skirt portion and the separable strip defined by a first line of weakness;

a second skirt portion depending from the separable strip, a boundary between the separable strip and second skirt portion defined by a second line of weakness; and a set of lugs extending inward on both the separable strip and the second annular skirt portion of the cap, the lugs of the cap and the lugs of the container neck constructed to slide relative to each other upon threading of the cap onto the container while engaging each other to prevent unthreading of the cap from the container, the separable strip removable from the cap to leave a tamper-indicating gap between the first and second skirt portions.

2. The tamper-evident system of claim 1 wherein the lugs of the container extend outward from the container neck.

3. The tamper-evident cap of claim 1 wherein the lugs of the cap extend inward from the second skirt portion.

4. The tamper-evident cap of claim 1 wherein the lugs of the container include staggered lugs for engaging lugs of the cap on either or both of the separable strip and second skirt portion.

5. The tamper-evident cap of claim 1 wherein the lugs of the cap are tapered to compress to maintain engagement with the lugs of the container.

6. The tamper-evident system of claim 1 wherein the set of lugs on the cap extend inward on the separable strip portion of the cap.

7. The tamper-evident system of claim 1 wherein the set of lugs on the cap extend inward on the second annular skirt portion of the cap.

* * * * *